US006109519A

United States Patent [19]

McClure

[11] Patent Number: 6,109,519

[45] Date of Patent: Aug. 29, 2000

[54] SECTIONAL PRECAST CONCRETE SECURITY MAILBOX

[76] Inventor: Dwight A. McClure, P.O. Box 1451, Cumming, Ga. 30130

[21] Appl. No.: 09/083,466

[22] Filed: May 22, 1998

Related U.S. Application Data

[60] Provisional application No. 60/047,552, May 23, 1997.

[51] Int. Cl.[7] ..... B65D 91/00

[52] U.S. Cl. ..... 232/17; 232/39; 232/43.1; 52/592.5; 52/592.6

[58] Field of Search ..... 232/17, 45, 38, 232/39, 29, 33, 43.1, 47; 52/218, 296, 604, 592.6, 592.5, 592.1; D99/31, 32

[56] References Cited

U.S. PATENT DOCUMENTS

| | | | |
|---|---|---|---|
| 1,074,275 | 9/1913 | MacLean | 52/296 |
| 3,735,919 | 5/1973 | Morgan | 232/17 |
| 4,753,386 | 6/1988 | Phillion, Sr. | 232/43.1 |
| 4,844,332 | 7/1989 | Long | 232/17 |
| 4,875,622 | 10/1989 | Lents | 232/39 |
| 5,060,908 | 10/1991 | Sofy | 232/17 X |
| 5,062,539 | 11/1991 | Chandler | 232/43.1 X |
| 5,148,974 | 9/1992 | Clapper | 232/17 |
| 5,226,276 | 7/1993 | Cahill | 52/592.6 |
| 5,361,977 | 11/1994 | Ogrodnick, Jr. | 232/39 |
| 5,454,509 | 10/1995 | Bellamy et al. | 232/39 X |
| 5,524,818 | 6/1996 | Party et al. | 232/35 |
| 5,833,132 | 11/1998 | Bachmeier | 232/17 X |

*Primary Examiner*—Terry Lee Melius
*Assistant Examiner*—William L Miller
*Attorney, Agent, or Firm*—Womble Carlyle Sandridge & Rice

[57] ABSTRACT

A modular precast decorative security mailbox column has a base, a midsection, and a top section stacked on one another to define a completed column. The midsection of the column defines an interior compartment and mail deposited through the mail receptacle of the column falls into the interior compartment where it can be retrieved through a rear door in the midsection. The decorative mailbox column is thus economical to install, attractive in appearance, and provides security and privacy against thief and mail tampering.

1 Claim, 4 Drawing Sheets

SECTIONAL PRECAST CONCRETE SECURITY MAILBOX

REFERENCE TO RELATED APPLICATION

This application claims the benefit of the filing date of U.S. Provisional Application Ser. No. 60/047,552 filed May 23, 1997.

TECHNICAL FIELD

The present invention relates generally to mailboxes and more specifically to masonry or masonry look mailboxes that also provide security features.

BACKGROUND OF THE INVENTION

Mailboxes for receiving mail at a residence or business have long been mounted in a wide variety of ways. One classic mailbox, for example, comprises a metal box mounted atop a wooden post. More recently, it has become popular to mount the mailbox in a brick or masonry column that may form a part of a brick wall or other structure. These masonry columns serve to protect the mailbox against vandalism and provide a pleasing esthetic addition to a residence.

While traditionally constructed masonry mailboxes look and function well, they nevertheless have been plagued with various problems and shortcomings. First, they typically have to be built from the ground up by a trained brick layer or mason. Accordingly, their construction is expensive. Furthermore, traditional masonry mailbox columns are very heavy and typically are secured atop a concrete pad in the ground. While this makes them secure, it also presents a hazard if a car should veer off the road and hit the structure. It is not uncommon for substantial damage and injury to be caused in such car accidents. Finally, traditional masonry mailbox columns, while protecting the mailbox itself against vandalism, provide very little protection against mail theft or tampering since they usually comprise a standard mailbox secured within the column.

Accordingly, there exists a need for a highly attractive decorative masonry or masonry-look mailbox column that can be assembled quickly and easily, that can be made to present a wide variety of looks and designs, that protects against mailbox vandalism and against mail theft, and that presents a much lower danger in the event that a car should veer off the road and hit the column. It is to the provision of such a mailbox column that the present invention is primarily directed.

SUMMARY OF THE INVENTION

Briefly described, the present invention comprises a masonry mailbox column that is made in three stackable sections that are precast from an appropriate aggregate such as cement or concrete. the lower section or base is anchored to the ground with a post or the like, the midsection houses a mail compartment and a rear door for retrieving mail from the compartment. The upper section, which is decorative, carries the mailbox receptacle through which mail can be deposited by a postman. During installation, a securing post or posts is preferably secured in the ground and the base placed over the post. In one embodiment, the base is molded with openings in its bottom for receiving the posts and the posts are secured in place with construction adhesive. In another embodiment, the base is hollow and, once in place over the post, is filled with sand to secure it to the ground and to the post. The sections are made so that they simply stack together with the midsection on top of the base and the upper section atop the midsection to form the finished column. The sections can be cast with a wide variety of exterior textures and looks including brick, stucco, rock, chinked stone, or the like.

A mailbox door is provided on the front of the upper section so that a mailman can access the mailbox receptacle to deposit mail. A removable tray is provided in the upper section as well. In one position, the tray receives mail so that it stays in the upper section similar to a traditional mailbox. In another position, the mail is allowed to drop from the upper section into the compartment in the midsection, which preferably has a lockable rear door. In this way, the mail is protected against being stolen or tampered with and a homeowner can access and retrieve the mail from the back of the mailbox column.

Since the mailbox column of the present invention is modular, precast, and hollow, should it be stuck by an errant vehicle, it simply breaks away into pieces, absorbing much of the energy of the impact and protecting the vehicle and its occupants against injury or damage.

Thus, it is an object of this invention to provide a decorative mailbox column that is precast and modular for quick and easy installation.

Another object of the invention is to provide a decorative mailbox column that provides security features to protect against vandalism and mail tampering.

A further object of the invention is to provide a decorative mailbox column that presents a much lower risk of damage and injury if struck by an errant vehicle.

These and other objects, features, and advantages of the present invention will become more apparent upon review of the detailed description set forth below taken in conjunction with the accompanying drawings, which are briefly described as follows.

DETAILED DESCRIPTION OF THE PREFERRED EMBODIMENTS

Figure 1:
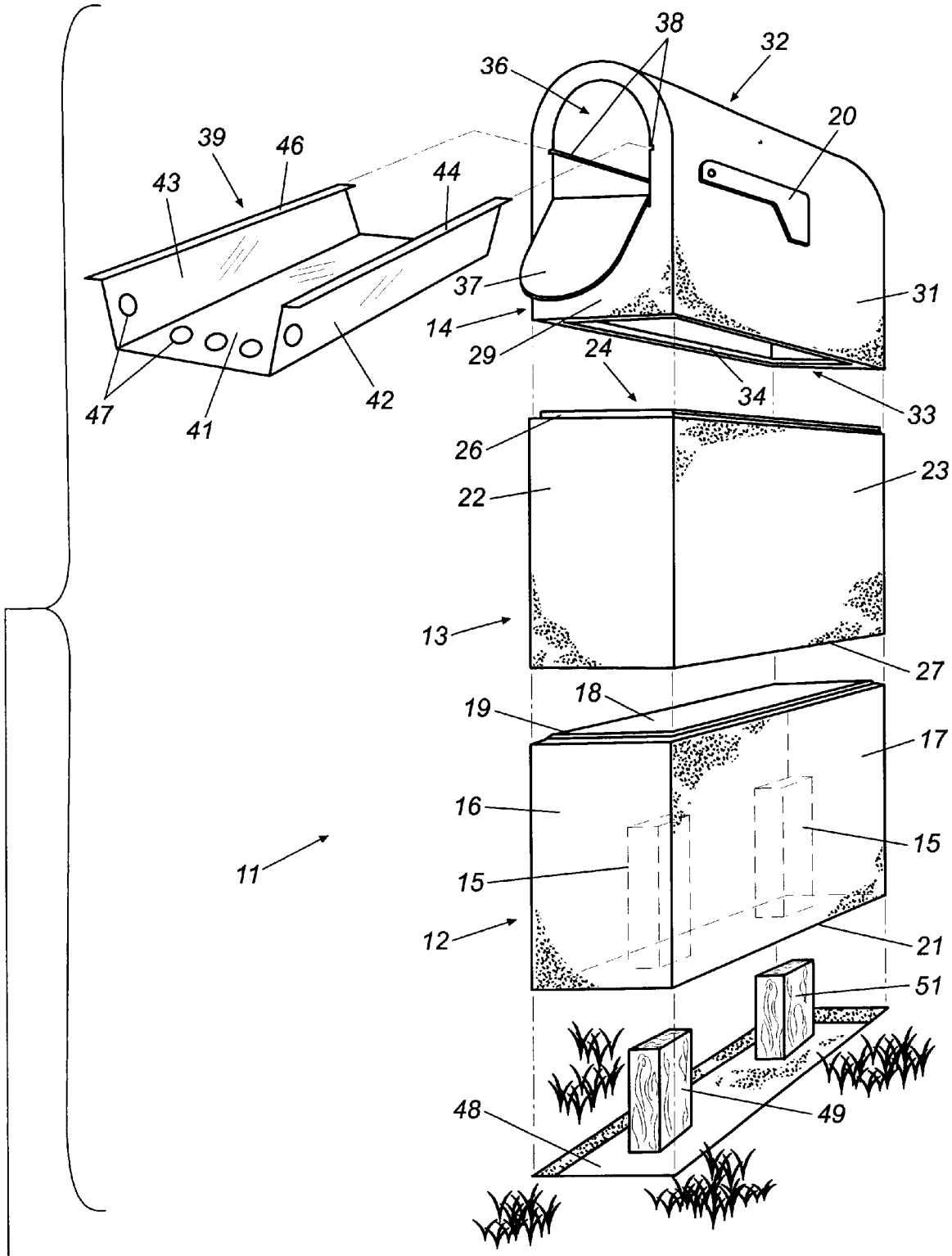
FIG. 1 is a perspective exploded view of a decorative mailbox column that embodies principles of the present invention in a preferred form.

Referring now in more detail to the drawings, in which like numerals refer to like parts throughout the several views, FIG. 1 is an exploded perspective view of a mailbox column that embodies principles of the present invention in a preferred form. The decorative mailbox column 11 is made of precast modular sections including a lower section or base 12, a midsection 13, and an upper section 14. In the preferred embodiments, all of the sections are precast from an appropriate aggregate such as cement or concrete and the precast sections are delivered and assembled into the finished decorative column on site.

The base 12 in the embodiment of FIG. 1 is formed with a front face 16, a side face 17, and a top 18. The upper peripheral edge of the base 12 is cast to define a recessed tongue 19 that extends around the entire periphery of the upper edge of the base.

The precast midsection 13 of the decorative mailbox column 11 is formed with a front face 22 and a side face 23. The midsection 13 preferably is hollow; that is, it is not formed with a top like the base 12. The upper peripheral edge 24 of the midsection 12 is formed to define a recessed tongue 26 that extends completely around the periphery of the midsection. The midsection 13 also has a lower peripheral edge 27 that is cast to define a recessed groove (described in more detail below) that is configured to receive the tongue formed in the base 12 for mating the two sections together.

The upper or top section 14 is also cast with a front face 29 and a side face 31. The lower peripheral edge 33 of the top section 14 is formed to define a recessed groove 34 that extends completely around the lower peripheral edge for receiving and mating with the tongue 26 of the midsection 13. In the embodiment of FIG. 1, the top section 14 has a simple curved crown 32. However, as discussed below, a wide variety of decorative crowns and, indeed, a wide variety of shapes and textures of all of the sections is possible.

A mail receptacle 36 is formed in the top section 14 for receiving mail placed in the mailbox by a postman or other mail deliverer. The receptacle 36 is accessible through a hinged door 37 that can be opened and closed as necessary for depositing mail in the mailbox. Preferably, the hinged door 37 is formed of a heavy gauge metal for security and can be provided with a latch or lock to prevent unauthorized access to the mailbox. An outgoing mail flag 20 is pivotable attached to the top section 14 and can be raised in the usual way to indicate the presence of outgoing mail in the box.

The interior sides of the top section 14 are formed with a pair of opposed slots 38 that extend from the mouth of the receptacle 36 to the back of the top section 14. A reversible tray 39 has a floor 41, upstanding sides 42 and 43, and flanges 44 and 46. The tray is sized and configured so that its flanges 44 and 46 can be received and slid into the slots 38 formed in the top section of the mailbox. An array of finger holes 47 are formed in the tray 49 to allow the tray to be removed from and inserted into the slots within receptacle 36. As described below, the tray can be inserted either right side up as oriented in FIG. 1 or upside down. When inserted in its right side up orientation, mail placed in the mailbox through the receptacle 36 rests on the floor 41 of the tray and stays in the top portion of the mailbox in the traditional way. However, when the tray 39 is inserted in its upside down orientation, mail placed in the mailbox falls down into the hollow midsection 13 of the column where it is inaccessible to vandals and mail tamperers. The midsection 13 preferably is formed with an access door 77 (FIG. 5) on its back side so that mail disposed therein can be retrieved by the owner of the mailbox.

The decorative mailbox column shown in FIG. 1 preferably is installed and assembled on site as follows. First, the precast sections 12, 13, and 14 of the column are delivered to the desired location. A shallow depression 48 is then dug into the ground at the location where the mailbox column is to reside. The depression 48 has a footprint that is the same as the footprint of the base 12 and its floor is leveled so that the base 12 can rest securely and plum on the floor of the depression. A pair of securing posts, which preferably are made from treated lumber, are secured in the ground so that they extend upwardly a predetermined distance from the floor of the depression 48. In the embodiment of FIG. 1, the base 12 is formed with a pair of upwardly extending passageways 15 that are shaped and positioned to receive the upstanding securing posts 49 and 51. To secure the base, construction adhesive is applied to the securing posts 49 and 51 and the base is placed over the posts with the posts extending into the passageways 15. In this way, the base is securely planted on the ground, leveled, and adhered to the posts 49 and 51 so that it cannot easily be toppled.

With the base secured in place, a bead of construction adhesive is deposited around the upper peripheral edge of the base and the midsection 13 is stacked atop the base. As the midsection is placed on the base, the recessed tongue 19 formed around the upper edge of the base is received into the recessed groove formed around the bottom peripheral edge 27 of the midsection to align and mate the two sections together. As the construction adhesive sets, the two sections become adhered together to form a substantially monolithic structure.

In a similar way, the top section 14 is secured to the midsection by applying construction adhesive around the upper peripheral edge 24 of the midsection and stacking the top section on the midsection. The tray 39 can then be inserted into the top section as shown by phantom lines in FIG. 1, whereupon the installation of the decorative mailbox column of this invention is complete.

It will be understood by masons and others skilled in the art of mailbox column fabrication that the installation of the present invention is substantially less time consuming and less expensive than building a decorative masonry mailbox column from scratch on the site. In fact, the decorative mailbox column of this invention can be completely installed and ready for use in about two hours as opposed to the approximately two days required to build a masonry column.

While the base 12 in FIG. 1 is shown with passageways 15 for receiving the securing posts 49 and 51, another option is that the base 12 can be formed as a hollow section and placed over the posts. Once the base is in place, its hollow interior is filled with sand or another heavy substance, which weights the base and secures it to the posts. Furthermore, any other suitable means for securing the base in place are also possible and are considered to be within the scope of the present invention. In fact, the base could be secured to a prepoured concrete pad or could simply be placed on a leveled dirt surface without any securing posts or other securing means. While some means of securing the base to the ground is preferred, clearly it is not a requirement of the invention.

In FIG. 1, the invention is illustrated in a simple imitation stucco styling for purposes of clarity of description. It will be clear, however, that a wide variety of stylings are possible using the modular concept of the present invention. FIGS. 2 through 6 illustrate a variety of possibilities that have been developed. The various stylings illustrated in FIGS. 2 through 6 are shown for illustration only and are not intended to limit the designs or stylings that could be achieved with the present invention.

Figure 2:
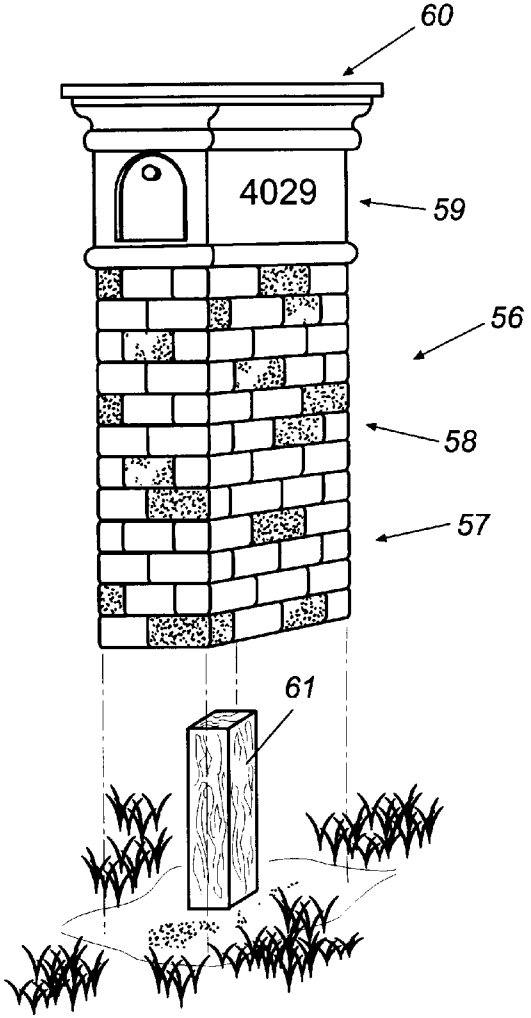
FIG. 2 illustrates the present invention in an alternate styling.

In FIG. 2, the present invention is shown with an exterior surface that mimics the look of traditional brick and mortar construction. The decorative column 56 of FIG. 2 comprises a base 57, a midsection 58 and a decorative top section 59. The basic configuration and assembly of the sections are the same as FIG. 1, except that the exterior and decorative surfaces of the mailbox column are textured differently. In addition, the top section 59 is shown with a decorative molding or crown 60 that enhances the appearance of the styling. This decorative crown 60 could be formed with and as a part of the upper section 59. Alternatively, the decorative crown 60 could be cast as a separate element and installed atop the upper section 59. The decorative column 56 in FIG. 2 is seen being anchored to the ground with a securing post 61. In FIG. 2, only a single securing post is shown and, in this embodiment, the base 57 might be formed with a single receptacle for receiving the post or, as mentioned above, could be hollow and filled with sand to secure the base to the post.

Figure 3:
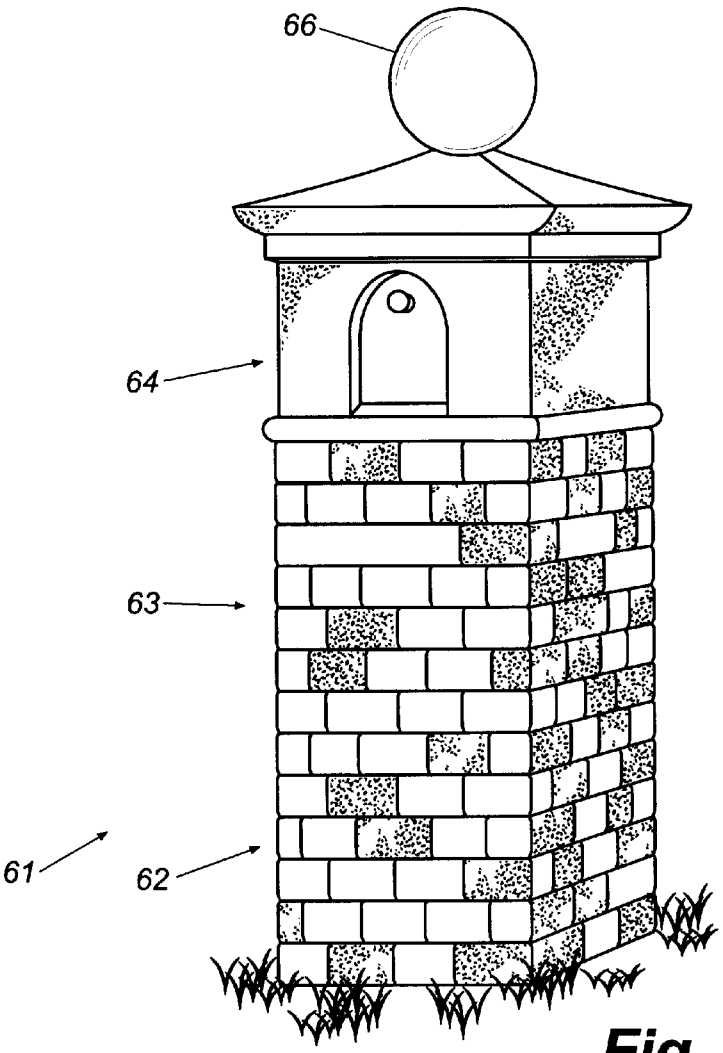
FIG. 3 illustrates another alternate styling embodying the invention.

FIG. 3 illustrates an alternate styling of the present invention. The decorative column 61 of FIG. 3 is essentially similar to that of FIG. 2 and has a base 62, a midsection 63, a top section 64, and a decorative crown 66. The decorative crown in the styling of FIG. 3 is of a different architectural design than that of FIG. 2. In this regard, it is advantageous to form the decorative crown 66 as a separate element that is installed over a basic top section 64. In this way, a wide variety of architectural designs can be achieved by combining basic elements with various decorative crowns.

Figure 4:
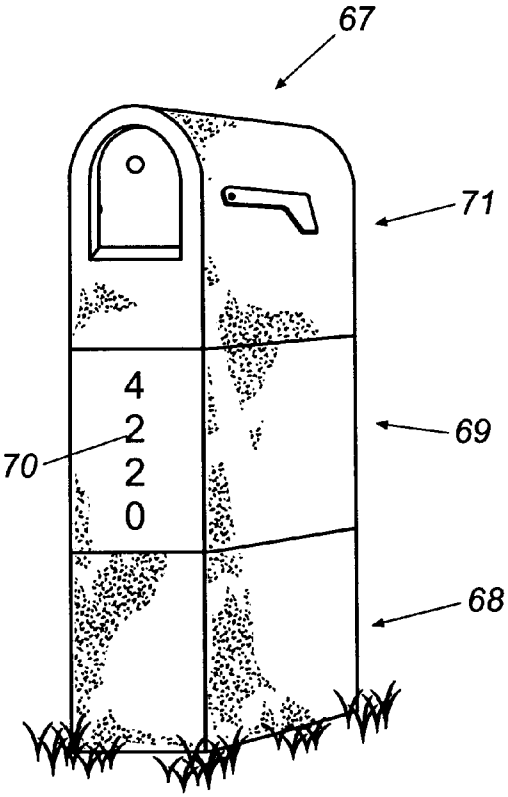
FIG. 4 illustrates another alternate styling.

FIG. 4 illustrates yet another styling of the present invention. This styling 67 corresponds to the embodiment shown in FIG. 1 and includes a base 68, a midsection 69, and a top section 71. Indicia 70 showing the street address of the mail recipient is displayed on the front of the mailbox to provide an even more pleasing and informative appearance.

Figure 5:
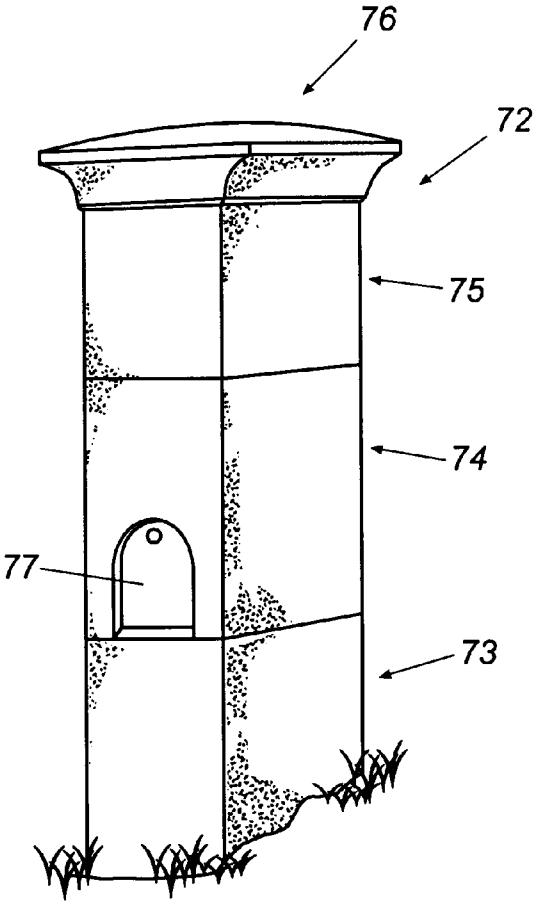
FIG. 5 illustrates another alternate styling from a rear perspective view showing the rear access door in the midsection.

FIG. 5 illustrates still another alternate styling of the present invention and shows the decorative mailbox column of this invention from the back side thereof. The column 72 in FIG. 5, as with the other stylings, has a base 73, a midsection 74, a top section 75, and a decorative crown 76. A lockable hinged access door 77 is seen to be formed in the midsection 74 of the column covering an access port. As mentioned above, one important security feature of the present invention is that the tray 39 (FIG. 1) can be oriented such that mail deposited through the mail receptacle in the front of the mailbox falls into the compartment defined by the midsection 74. This mail is then inaccessible to those who might otherwise tamper with the mail. When the owner of the mailbox wishes to retrieve the mail, the rear access door 77 is unlocked and opened, whereupon the mail can be retrieved from the compartment. Accordingly, the decorative mailbox column of the present invention, in addition to being efficient and economical to install, provides valuable security and privacy for mail that is delivered to the box.

Figure 6:
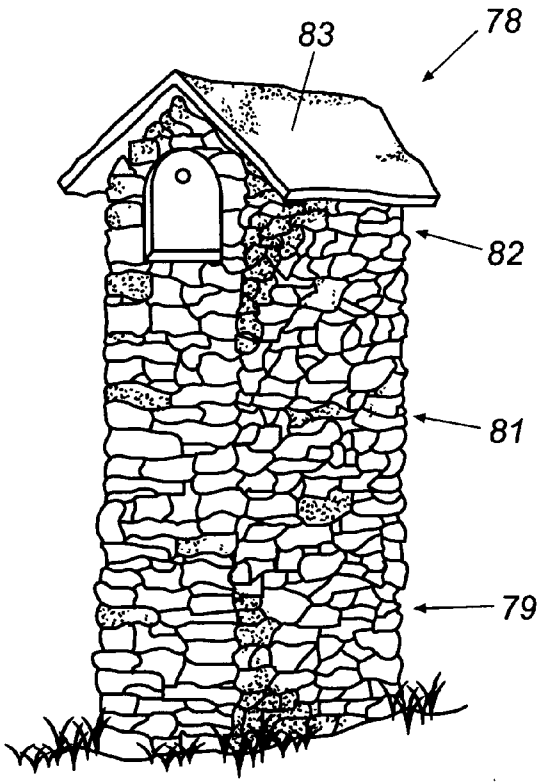
FIG. 6 illustrates another alternate styling.

Finally, FIG. 6 illustrates a still further alternate styling that embodies principles of this invention. In the styling of FIG. 6, the decorative mailbox column 78 comprises a base 79, a midsection 81, a top section 82, and a decorative roof or crown 83. In this styling, the exterior surfaces of the various sections are textured to present the appearance of a chinked stone construction common in colonial farm houses. The sections are cast so that when they are stacked atop one another, the chinked stone design appears to be continuous from the bottom of the column to its top. In the styling of FIG. 6, the top section 82 is seen to be formed with a gabled upper peripheral edge and gabled roof sections, which can be slate, marble, cast panels, or otherwise, are installed atop the column to present a pleasing aesthetic appearance. As with all the other stylings, the styling of FIG. 6 includes a removable tray that can be oriented to allow mail to drop into the midsection for security if desired.

Figure 7:
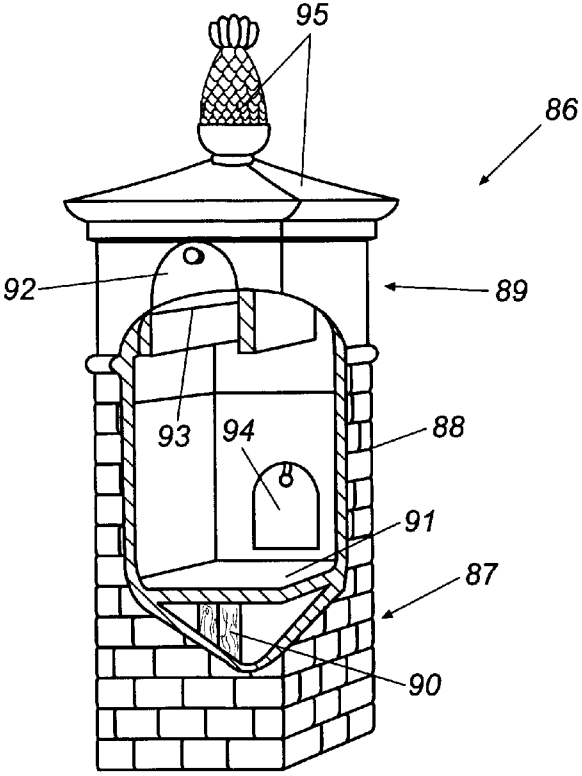
FIG. 7 is a perspective partially cut away view of the present invention showing internal elements of the invention.

FIG. 7 illustrates in a partially sectioned view the various internal components and compartments of the assembled decorative mailbox column of this invention. The column 86 is seen to be constructed of a base 87, a midsection 88, and a top section 89. A decorative crown 95 is installed atop the top section 89 and, in this embodiment, includes a pineapple, which is a traditional symbol of welcoming. The base 87 is formed with a top 91 that also defines the floor of the interior compartment formed by the midsection 88. A lockable rear door 94 is hingedly attached to the back of the midsection 88 covering an access port for accessing the internal mail compartment. The top section 89 has a hinged mail receptacle door 92 for depositing mail into the mailbox.

Slots 93 are provided for inserting, removing, and/or reorienting the tray 39 (FIG. 1) for retaining mail in the top section or allowing it to drop into the compartment defined by the midsection 88. In FIG. 7, the tray is seen removed for clarity. The base 87 is seen secured to the ground by means of a securing post 90. In the embodiment of FIG. 7, the base 87 is hollow and is secured to the post 90 by means of sand or other heavy material filling the interior of the base 87. Alternatively, the base could be formed with a receptacle or passageway for receiving the post 90, whereupon the post would be secured with construction adhesive or the like.

It will be appreciated from FIG. 7 that when mail is deposited through the door 92 of the mailbox column, it drops downwardly into the compartment defined by the midsection 88. The mail is thus secure from mail tampering. When it is desired to retrieve the mail, the back door 94 is simply unlocked and hinged downwardly where upon all of the mail collected in the midsection compartment can be removed by the owner of the mailbox.

Figure 8:
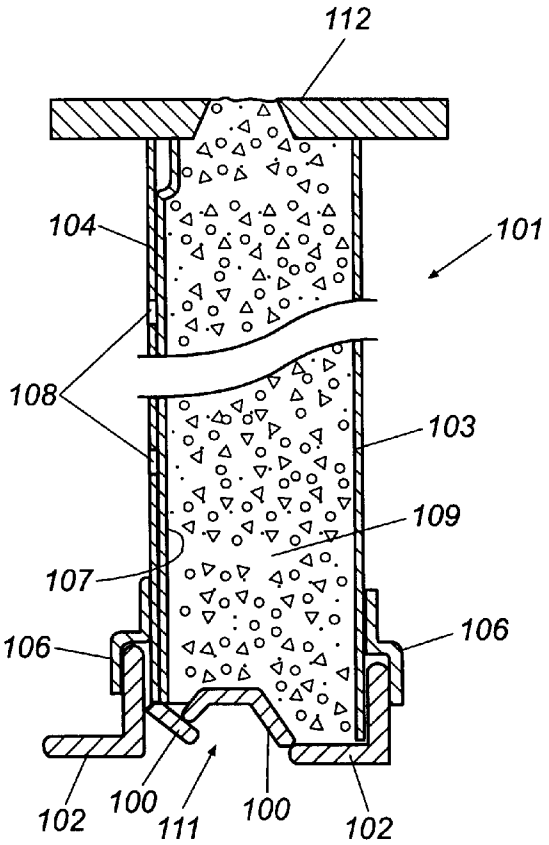
FIG. 8 illustrates one mold and process for casting the decorative mailbox column of this invention.

FIG. 8 illustrates one preferred embodiment of a mold that can be used to cast the sections of the present invention. While FIG. 8 is a cross-sectional view through one face of the mold, it will be understood that the mold is generally box shaped to form the completed rectangular sections of the invention. The mold 101 comprises a pair of feet or dogs 102 that are secured to an appropriate surface. An inside panel 103 is secured on the inside dog 102 by lower clip members 106. Similarly, an outside panel 104 is secured to the outside dog 102 by a clip 106. The inside and outside panels 103 and 104 preferably are formed from heavy gauge metal sheeting to withstand the outward pressure of the cement or concrete when it is poured into the mold.

In order to form the various exterior textures of the present invention, a textured panel 107 is inserted in the mold and resides against the exterior panel 104 thereof. The textured panel 107 preferably is formed of vacuum molded plastic material and is configured to shape the aggregate 109 to form the desired texture. In FIG. 8, the decorative panel 107 has a slightly textured substantially flat inside surface to form an imitation stucco texture such as shown in the styling of FIGS. 1 and 4. In other embodiments, the textured panel 107 is formed to imitate the look of brick, chinked stone, or any other exterior surface texturing that is desired. An array of weep holes 108 are formed in the outside panel 104 to allow air trapped between the decorative panel 107 and the panel 104 to escape so that the decorative panel rests firmly against the panel 104.

The bottom of the mold is defined by angled metal sections that form the lower peripheral edge of the aggregate 109 into the recessed groove configuration discussed above. The mold 101 is topped by a cap 112 that, in conjunction with the upper edge 140 of the textured panel 107, defines the recessed tongue around the top peripheral edge of the cast section.

With the mold 101 assembled as shown in FIG. 8, an appropriate aggregate 109 such as, for example, cement or concrete or another appropriate casting aggregate, is poured into the mold through the opening in the cap 112 until the mold is filled. Preferably, the mold is vibrated in some traditional manner to insure that the aggregate fills all of the spaces and that there is no trapped air inside the mold. Once the mold is filled, the aggregate is allowed to cure, whereupon the mold is removed to reveal the finished cast section. In this regard, the mold is simply lifted upwardly off of the dogs 102, whereupon the panels can easily be pulled away from the casting. The casting can then be finished to remove any rough portions and can be primed, painted, or otherwise treated as desired to present the appropriate appearance. While the particular mold shown in FIG. 8 is considered to be preferable, it should not be considered to be a limitation of the invention. A wide variety of molding techniques could be applied to cast the segments of the present invention and all such molding techniques are considered to be within the scope of the invention.

Figure 9:
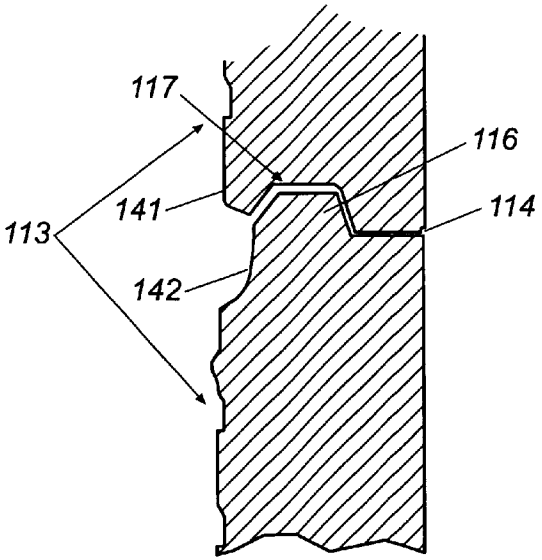
FIG. 9 is a close up cross-sectional view of a joint between sections of the decorative mailbox column.

FIG. 9 illustrates a cross-sectional enlarged view of the cooperation of the tongue and groove arrangement to mate and lock the sections of the present invention together. As discussed above, the lower section 113 is cast with a recessed upwardly projecting tongue 116 and the upper section 113 is cast with a recessed groove 117 that is configured to receive the tongue 116. Preferably, before stacking one section on another, the junction 114 between the sections is provided with a bead of construction adhesive or other appropriate adhesive to secure the sections together and to prevent the migration of moisture between the sections. As seen in FIG. 9, when the sections are joined together, the tongue and groove arrangement aligns the sections appropriately and the upper section forms a small depending lip 141 that aids in the drainage of rainwater and prevents the rain water from migrating into the interior of the column. The exterior texture of the column shown in FIG. 9 is seen to be rough and could correspond, for example, to an imitation brick exterior. For this purpose, the top portion of the lower section is formed with an indentation 142 that imitates a grouted joint between bricks. In this way, the completed assembled column appears to be one continuous structure and the junction between the various sections is hidden and disguised.

Another unique advantage of the present invention is its safety if accidentally struck by an errant vehicle. Prior art masonry mailbox columns present a grave danger in the event of such an accident because they are very heavy and secured firmly with concrete. Thus, in the event of an impact, a vehicle typically sustains substantial damage, and in some cases, the occupants of the vehicle can be injured by the impact. In the event that an errant vehicle strikes a decorative mailbox column of the present invention, the securing posts with which the column is mounted to the ground are simply sheared away and the various sections of the column shatter into small shards. Accordingly, the column absorbs much of the energy of the impact and, although it is destroyed in the impact, greatly reduces the chance of serious injury to the occupants of the vehicle and also reduces damage to the vehicle itself. Thus, in addition to the other features and advantages of this invention, it is also inherently a much safer product in the event of an automobile accident.

The invention has been described herein in terms of preferred embodiments and methodologies. It will be obvious to those of skill in the art, however, that various additions, deletions, and modifications might well be made to the illustrated embodiments within the scope of the invention. For example, while the preferred embodiments have been illustrated as being formed from three separate sections, clearly the column of the present invention could be formed from more than three sections or less than three sections. In fact, the column could be formed as a single monolithic cast unit and delivered to a site for installation in one piece. Furthermore, the various stylings and architectural designs illustrates herein are exemplary only and not intended to limit the invention in any way. Obviously, a virtually endless array of architectural stylings and designs could be achieved using the principles of the present invention. These and other additions, deletions, and modifications might well be made to the preferred embodiments without departing from the spirit and scope of the invention as set forth in the claims.

I claim:

1. A method of fabricating a sectioned pre-cast decorative mailbox column comprising the steps of:

(a) pre-casting a base;

(b) pre-casting a mid-section to define an interior compartment and an access port, the mid-section being configured to mate with and rest atop the base;

(c) pre-casting a top configured to mate with and rest atop the mid-section and being formed with a mail receptacle;

(d) securing the base on the ground;

(e) stacking the mid-section on the base;

(f) stacking the top on the mid-section to form the decorative mailbox column, the mail receptacle of the top communicating with the interior compartment of the mid-section to allow mail deposited in the mail receptacle to fall into the interior compartment of the mid-section; and (g) fabricating a tray selectively insertable and selectively orientable in the top, the tray having a first orientation wherein mail deposited in the mail receptacle rests on the tray and resides in the top and a second orientation wherein mail deposited in the mail receptacle falls into the interior compartment defined by the mid-section.

* * * * *